US006062705A

United States Patent [19]

Zimmer et al.

[11] Patent Number: 6,062,705

[45] Date of Patent: May 16, 2000

[54] SEASONAL DRAIN-THROUGH SOCKET HOUSING

[75] Inventors: John J. Zimmer, Cherry Hill, N.J.; Gerald C. Malone, Hellertown; Gary W. Bryde, Catasauqua, both of Pa.; Theodore M. Monette, Hamilton Square, N.J.

[73] Assignee: Triboro Electric Company, L.P., Doylestown, Pa.

[21] Appl. No.: 09/150,058

[22] Filed: Sep. 9, 1998

[51] Int. Cl.[7] ..... H01R 33/00

[52] U.S. Cl. ..... 362/226; 362/249; 362/294; 439/699.2

[58] Field of Search ..... 362/226, 249, 362/294, 391; 439/699.2

[56] References Cited

U.S. PATENT DOCUMENTS

| | | | |
|---|---|---|---|
| 5,228,774 | 7/1993 | Liao | 362/391 |
| 5,339,232 | 8/1994 | Lin | 362/391 |
| 5,626,415 | 5/1997 | Huang | 362/226 |
| 5,643,006 | 7/1997 | Wang et al. | 439/419 |
| 5,660,560 | 8/1997 | Cheng et al. | 439/419 |
| 5,707,138 | 1/1998 | Pan | 362/226 |
| 5,752,765 | 5/1998 | Liou | 362/226 |
| 5,775,933 | 7/1998 | Chen | 439/419 |
| 5,915,826 | 6/1999 | Lin | 362/226 |

*Primary Examiner*—Laura K. Tso
*Attorney, Agent, or Firm*—Cantor Colburn LLP

[57] ABSTRACT

The present invention is directed to a seasonal lamp socket for use outdoors in a variety of meteorological conditions, including rain, whereby a liquid or a gas is prevented from accumulating in the socket body in accordance with the present invention. The lamp socket and more particularly, the socket housing provides drain-through passageways which permit a liquid or a gas to enter into the interior of the socket housing and fluidly flow the length of the socket housing before draining out of the socket regardless of the socket orientation during use. Importantly, these drainage passageways prevent a liquid or gas from accumulating in the socket housing and causing damage to the electrical components thereof. Thus, the seasonal lamp socket of the present invention is intended for electrical lamp applications outdoors under adverse meteorological conditions.

15 Claims, 4 Drawing Sheets

SEASONAL DRAIN-THROUGH SOCKET HOUSING

BACKGROUND OF THE INVENTION

1. Field of the Invention

This invention relates generally to lamp sockets, and relates more particularly to a seasonal socket housing which permits a liquid, e.g, rain water, or a gas to drain-through the socket housing to avoid the liquid or gas from pooling in the socket housing and thus damaging the electric circuit.

2. Brief Discussion of the Related Art

Typically, a lamp socket is comprised of a socket body having a conductive center contact and a conductive side contact and an electrical wire is held against the center and side contacts so that an electrical connection is made between the wire and the contacts when the housing is assembled and the pointed tips of the contacts are forced to pierce the insulator of the electrical wire and to make electrical contact with the respective conductor in the electric wire. The lamp socket is designed to receive a conventional lamp bulb of a predetermined size and when the base of the lamp bulb is threaded into the internally threaded socket body, a first and a second contact of the lamp bulb are forced into contact with center and side contacts of the lamp socket, and therefore the electric circuit is closed, and the lamp bulb is lightened.

While this conventional socket structure is functional, it does suffer from a serious limitation, namely that is particularly unsuitable for use in an outside environment where the lamp socket and bulb are subjected continuously to rain water and moisture as a normal occurrence. When the lamp socket is used outdoors during a rainy day, rain water tends to accumulate in the socket housing and pool therein. As the rain water accumulates, it will cause the center and side contacts to be short circuited and if one was to touch the lamp socket with the hand when the socket is short circuited due to the rain water accumulation, an electric shock tends to occur. At the very least, this type of socket housing is inconvenient and not entirely fully operational outdoors and on a more serious note, the socket housing may pose a health risk due to its tendency to short circuit when rain water accumulates therein. Thus, because typical lamp sockets cannot effectively prevent rain water from accumulating in the socket housing where live electrical wires are disposed, they are unsuitable for use outdoors. In addition, other meteorological conditions, such as moisture (dew), snow, and high levels of humidity may impact the capability of the lamp socket to effectively function in an outdoor environment subject to these adverse conditions. Thus, from the foregoing discussion, it can be seen that it would be advantageous to provide a lamp socket which is suitable for use outdoors during a rainy day due to its socket design which permits rain water to drain through and does not facilitate a short circuit in the socket.

SUMMARY OF THE INVENTION

The above-described drawbacks and deficiencies of the prior art are overcome or alleviated by the lamp socket of the present invention. The lamp socket comprises a socket housing having at one end a receiver portion for the insertion of a light bulb and a rear skirt at an opposite end. Formed within the rear skirt are wireways for mounting a pair of electric wires to the electrical contacts of the lamp socket. One of the electrical contacts comprises a metal shell which is inserted into and mounted within the socket housing, wherein the metal shell has internal threads for receiving the light bulb. The end of the metal shell which is securely mounted to the housing contains a center slot opening for receiving the second contact of the lamp socket. This second contact is connected to a center support which extends between the annular outer wall of the rear skirt. When the light bulb is threaded into the metal shell, the end most metal portion of the light bulb seats against the second contact resulting in a completed electrical circuit and thus lighting of the light bulb. In accordance with the present invention, the lamp socket and more particularly, the socket housing provides drain-through passageways which permit a liquid or a gas to enter into the interior of the socket housing and fluidly flow the length of the housing before draining out of the socket housing regardless of the socket orientation during use. Importantly, these drainage passageways prevent a liquid or gas from accumulating in the socket housing and causing damage or injury to the electrical components or any individual who is in contact with the lamp socket. If liquid or gas accumulation is permitted, the lamp socket is likely to short circuit and present at least an inconvenience to the user and more seriously, may pose a serious risk to the health of any individual in contact with the lamp socket. Thus, in accordance with the present invention, the lamp socket of the instant invention may be used outdoors subject to a variety of adverse meteorological conditions without short circuiting or posing a serious health risk.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
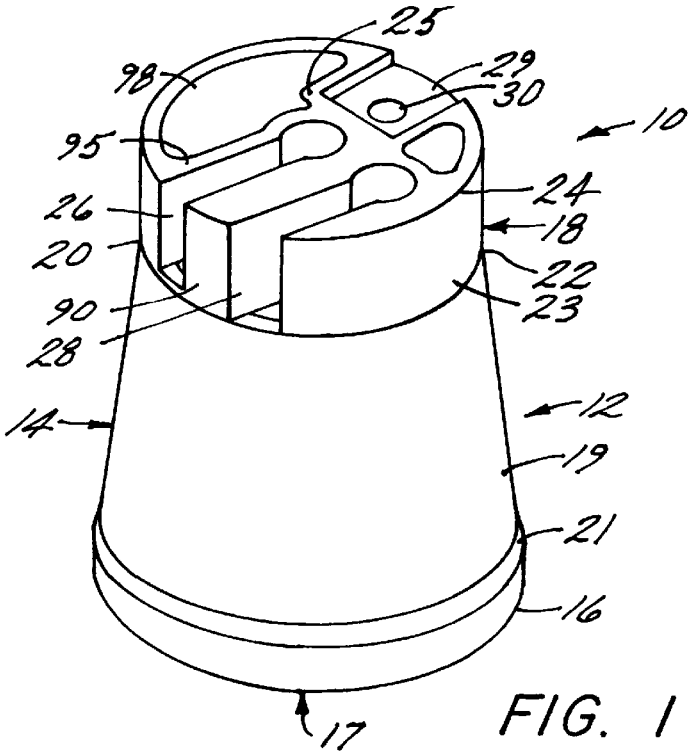
FIG. 1 is a perspective view of a seasonal lamp socket in accordance with the present invention.
Figure 7:
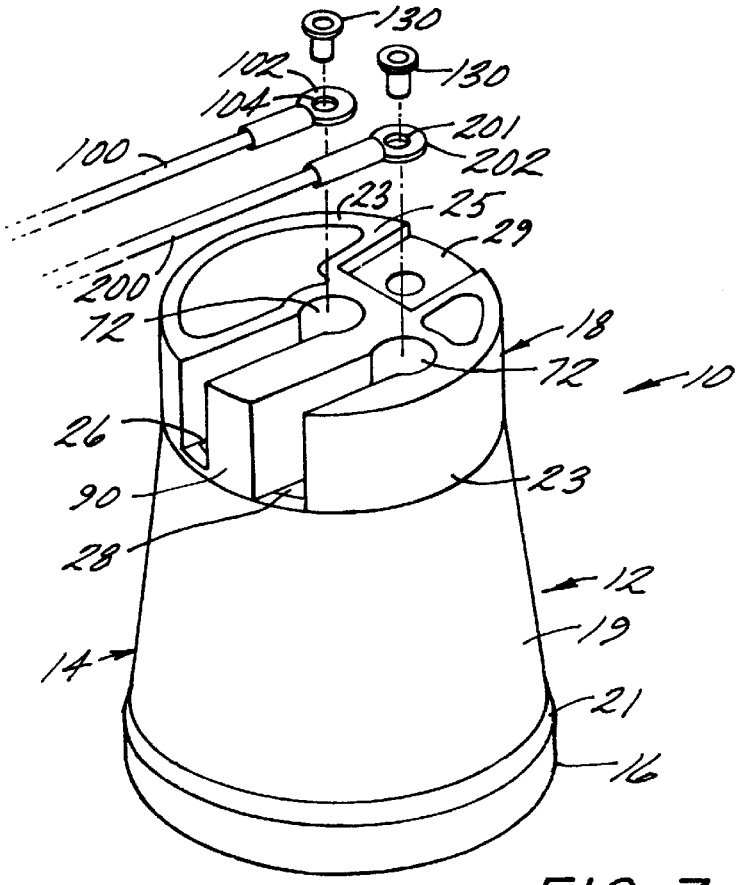
FIG. 7 is a partially exploded perspective view of the seasonal lamp socket of FIG. 1.

Referring to FIG. 1, the lamp socket of the present invention is generally shown at 10. Lamp socket 10 comprises a socket housing 12 having a receiver portion 14 and a rear skirt 18. At first end 16 of receiver portion 14 is an opening 17 for receiving an A19 type light bulb and other types of light bulbs (not shown). Opening 17 is defined by an annular outer wall 19 of receiver portion 14, wherein the annular outer wall 19 extends between first end 16 and a second end 20 opposite first end 16. Annular outer wall 19 has an outwardly tapered portion 21 at first end 16. Rear skirt 18 includes a first end 22 which abuts second end 20 of receiver portion 14 and a second end 24 opposite first end 22. Extending between first end 22 and second end 24 of rear skirt 18 is an annular outer wall 23. Rear skirt 18 further includes an outer surface 25 extending between annular outer wall 23 of rear skirt 18 at second end 24, wherein a pair of recessed wireways 26 and 28 and a recessed mounting slot 29 are formed within outer surface 25. Wireways 26 and 28 are for receiving electric wires (as shown in FIG. 7) and recessed mounting slot 29 is for receiving a mounting bracket (not shown) or similar mounting member so that lamp socket 10 may be mounted to a variety of structures. Recessed mounting slot 29 includes an opening 30 to secure the mounting bracket to rear skirt 18 of housing 12 by fastening means known in the art.

Figure 2:
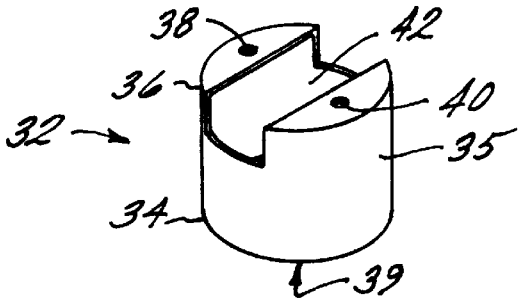
FIG. 2 is a perspective view of a metal screw shell for insertion into the seasonal lamp socket of FIG. 1.

Turning now to FIGS. 1 and 2, housing 12 is designed so that opening 17 receives a threaded shell 32 which is securely fastened to housing 12, as will be described in more detail hereinafter. More specifically, the diameter of annular outer wall 19 of housing 12 is of a predetermined size so that shell 32 is received through opening 17 and is disposed and fastened to housing 12 between annular outer wall 19. As shown in FIG. 2, threaded shell 32 is preferably an annular member having a first end 34 and an opposite second end 36 with an outer wall 35 disposed therebetween. At first end 34 is an opening 39 for receiving the light bulb (not shown). Second end 36 of shell 32 is fastened to second end 20 of housing 12 by means known in the art, and preferably, shell 32 includes a pair of openings 38 and 40 at second end 36 to permit fastening of shell 32 to housing 12 with conventional rivets (not shown) or other suitable fasteners. Second end 36 of shell 32 further includes a center slot opening 42 disposed between openings 38 and 40 for receiving a center contact and center support (not shown) when shell 32 is installed in and fastened to socket 12, as will be described hereinafter. Center slot opening 42 further permits the metal portion of the light bulb to make an electrical connection with the center contact of lamp socket 10. Outer wall 35 includes on the inside thereof an internal thread (not shown) for receiving and securing the light bulb within shell 32, and preferably, shell 32 is formed of a conductive metal material. When installed into socket housing 12, shell 32 comprises the side contact of lamp socket 10 and is forced into contact with a respective conductor of an electric wire (not shown) by securing the electric wire directly onto shell 32, as described hereinafter.

Figure 3:
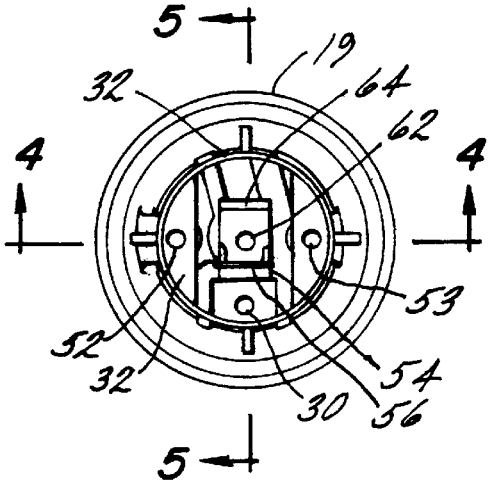
FIG. 3 is a top view of the seasonal lamp socket of FIG. 1 having the metal screw shell inserted and fastened therein.
Figure 4:
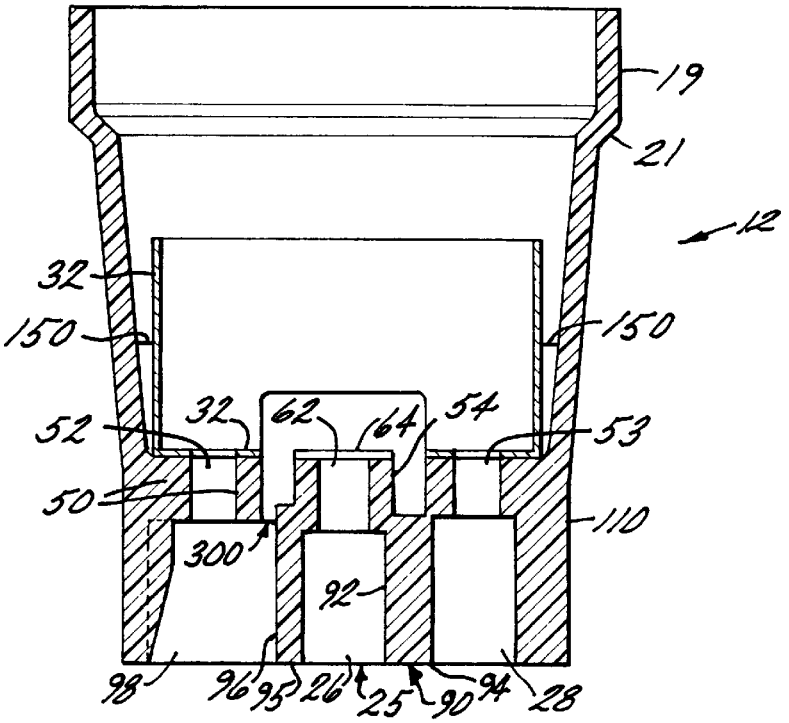
FIG. 4 is a cross-sectional view taken along the line 4—4 of FIG. 3.
Figure 10:
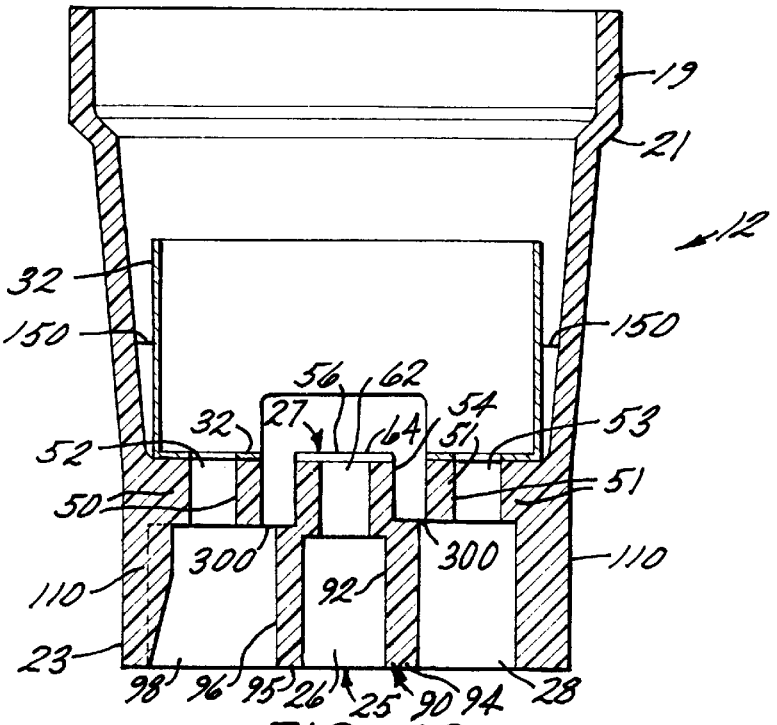
FIG. 10 is a cross-sectional view taken along the line 10—10 of FIG. 9.
Figure 5:
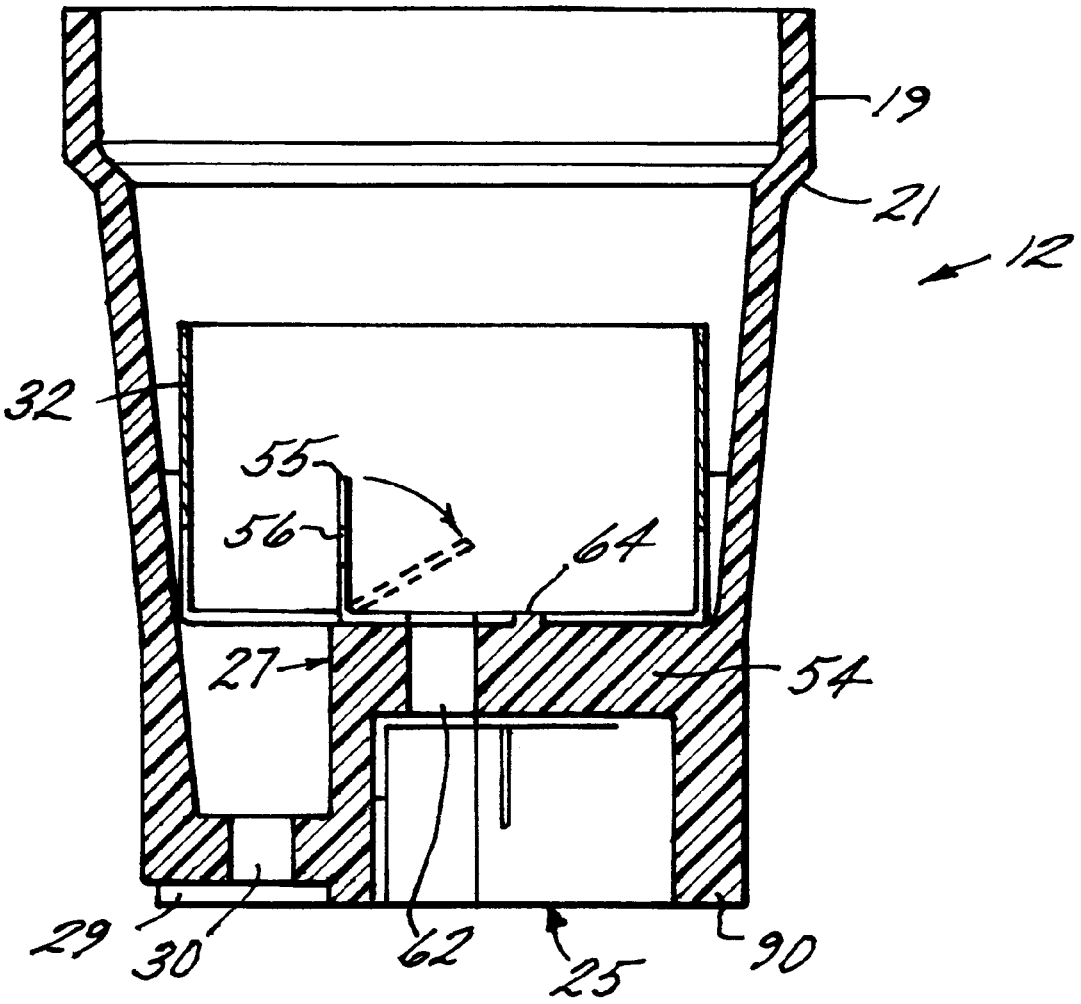
FIG. 5 is a cross-sectional view taken along the line 5—5 of FIG. 3.

FIGS. 3–7 illustrate in more detail the structure of housing 12 in accordance with the present invention. FIG. 3 is a top view of lamp socket 10 having shell 32 inserted in and securely fastened to housing 12. Turning to FIGS. 4–5, rear skirt 18 includes an inner surface 27 extending between annular outer wall 23 at first end 22 of rear skirt 18 proximate second end 20 of receiver portion 14, wherein a cantilevered support member 50 and a side support beam 51 are formed within inner surface 27. Cantilevered support member 50 and a side support beam 51 are integrally connected to annular outer wall 23 of rear skirt 18 and extend inwardly from annular outer wall 23. Shell 32 is designed to rest upon cantilevered support members 50 and side support beam 51 and shell 32 is fastened to housing 12 by means of openings 52 and 53 which extend through cantilevered support member 50 and side support beam 51, respectively, and are designed to receive fasteners, e.g., eyelits or rivets. When shell 32 is inserted into and secured to housing 12, openings 52 and 53 axially align with openings 38 and 40 of shell 32 to permit a fastener (eyelit) to extend through the openings and securely fasten shell 32 to housing 12. Side support member 51 further includes a center support portion 54 which supports a center contact 56. Center support portion 54 has an opening 60 for receiving a fastener, e.g., eyelit, which is used to secure center contact 56 to center support portion 54 of housing 12. Furthermore, opening 60 also captures a terminal 102 which has been crimped onto the end of an electric wire 100 (as shown in FIG. 7) and secures terminal 102 to center contact 56 so that electrical contact is made between one conductor of electric wire 100 and center contact 56. Preferably, terminal 102 of electric wire 100 is secured to center contact 56 and housing 12 by means of disposing an eyelit 130 through terminal center opening 104; however, other fasteners may be used successfully.

As shown in FIGS. 4 and 7, wireways 26 and 28 are formed in outer surface 25 of rear skirt 18 and an inner portion 110 of annular outer wall 23 of rear skirt 18 is integrally connected to cantilevered support members 50 and side support beam 51, as shown in more detail in FIG. 4. Wireway 26 receives electric wire 100 and wireway 28 in rear skirt 18 receives an electric wire 200 having a terminal 202 crimped onto one end thereof. Terminal 202 is secured to shell 32 by aligning a center opening 204 of terminal 202 with openings 40 and 53 (not shown) located at one end of wireway 28 and disposing a fastener (eyelit 130) through the terminal center opening 204 and openings 40 and 53 of shell 32 and side support beam 51, respectively.

At one end, wireways 26 and 28 include rounded openings 72 integrally formed in outer surface 25 of rear skirt 18 for receiving terminals 102 and 202 of wires 100 and 200. Wireways 26 and 28 of rear skirt 18 extend outward from rounded openings 72 of rear skirt 18 toward annular outer wall 23 of rear skirt 18 so that rear skirt 18 extends beyond the mounting surface of wire terminals 102 and 202 and in particular the crimped portion of the wires 100 and 200 when wires 100 and 200 are fastened to housing 12 thereby preventing possible contact with the electrical surfaces during handling of lamp socket 10. In particular, rounded openings 72 communicate with openings 62 and 53 of housing 12 so that terminals 102 and 202 may be securely disposed within wireways 26 and 28. Outer surface 25 of rear skirt 18 further includes a separation rib 90 disposed between wireways 26 and 28, wherein separation rib 90 partially defines wireways 26 and 28 so that wires 100 and 200 may be securely positioned therein and fastened to shell 32 and housing 12, and more particularly to center contact 56 and shell 32, respectively, to provide electrical contact therebetween.

Separation rib 90 has an inner portion 92 which is integrally connected to center support portion 54 and side support beam 51. Outer portion 94 of separation rib 90 serves to separate electric wires 100 and 200 as discussed hereinbefore. Between side support beam 51 and center support portion 54 is a channel 99 which is formed by side support beam 51, center support portion 54, and separation rib 90. Separation rib 90 also provides obstructions for possible contact during handling to ensure increased safety.

Disposed between wireway 26 and annular outer wall 23 of rear skirt 18 and formed within outer surface 25 of rear skirt 18 is an inner wall 95 which partially defines wireway 26 and along with annular outer wall 23 forms a recessed area 98 in rear skirt 18. Inner wall 95 has an inner portion 96 which is integrally connected to center support portion 54. Disposed within recessed area 98 is opening 52 of supporting member 50. Recessed area 98 is of a predetermined area so that a rivet or fastener may be inserted into opening 52 to securely engage shell 32 and with housing 12.

Turning to FIG. 5, during the final assembly of lamp socket 10, upper portion 55 of center contact 56 is folded downward toward a rib 64 disposed on center support portion 54 so that center contact 56 seats against rib 64 during final assembly. FIG. 5 illustrates an intermediary position wherein center contact is being folded downward in the direction of the arrow and upper portion 55 is indicated in phantom in the intermediary position. Upper portion 55 of center contact 56 seats against rib 64 when the light bulb (not shown) is threaded into shell 32 to permit the endmost area of the metal portion of the light bulb (not shown) to contact center contact 56 when the light bulb is fully engaged in lamp socket 10 by threading the light bulb into shell 32 resulting in a completed electrical circuit, as is known in the art.

Figure 6:
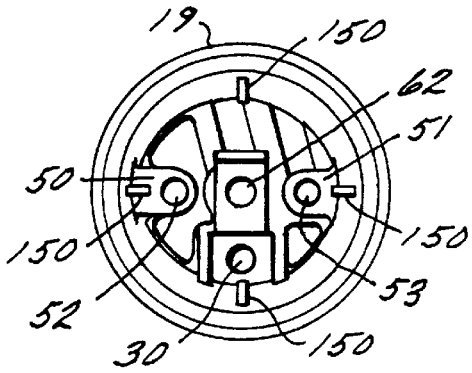
FIG. 6 is an additional top view of the seasonal lamp socket of FIG. 1 without the metal screw shell inserted therein.

As shown in FIGS. 4 and 6, shell 32 is additionally supported within housing 12 by a plurality of gussets 150 which are equally spaced about the inside of annular outer wall 19 of housing 12. Gussets 150 are disposed between annular outer wall 19 of housing 12 and shell 32 when shell 32 is inserted into housing 12 and secured thereto. Gussets 150 are positioned to run parallel to the axial length of housing 12 and gussets 150 may be integrally formed in annular outer wall 19 of housing 12 when housing 12 is manufactured by means known in the art, e.g., injection or pressure molding.

Figure 8:
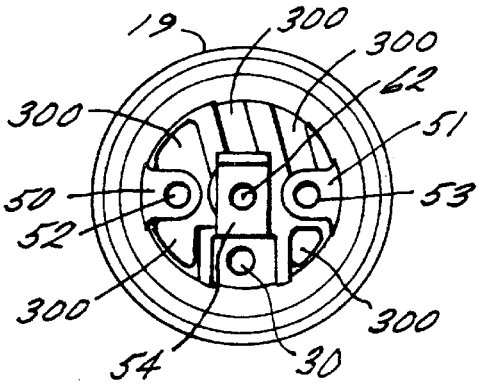
FIG. 8 is top view of the seasonal lamp socket of FIG. 1, illustrating drain passageways therein.

Turning to FIG. 8, in accordance with the present invention, lamp socket 10 and more particularly, socket housing 12 includes a plurality of drain-through passageways 300 which permit the entrance of a liquid or a gas into the interior of housing 12 in the area of the sockets electrical contacts and allow the liquid or gas to fully drain out regardless of the socket orientation during use. Formed within inner surface 27 of rear skirt 18 and defined by cantilevered support member 50 and side support beam 51 is at least one cavity in fluid communication with a plurality of drainage passageways 300 which permit a liquid or gas to completely flow the entire length of socket housing 12 from one end to the opposite end and exit the socket housing 12 at either end 16 of receiver portion 14 or end 24 of rear skirt 18. Importantly, because the cavities formed within inner surface 27 have corresponding drainage passageways 300 in fluid communication therewith, liquid, e.g., rain water, is prevented from accumulating in these cavities in inner surface 27 of rear skirt 18 when lamp socket 10 is used outdoors as a seasonal socket. Furthermore, the cavities formed within inner surface 27 of rear skirt 18 are in fluid communication with receiver portion 14 and the openings within shell 32 to permit the above-described drainage capabilities.

Figure 9:
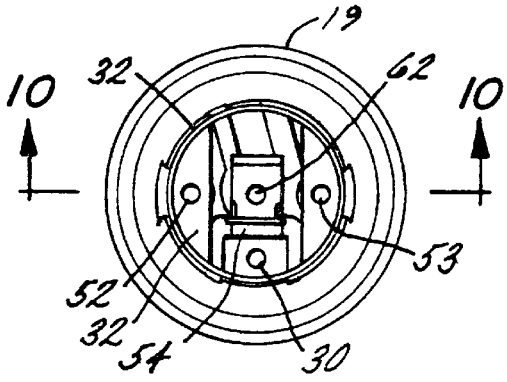
FIG. 9 is a top view of an alternative embodiment of the seasonal lamp socket of the present invention.

Turning to FIG. 9, in which an alternative embodiment of housing 12 is illustrated, wherein the principle difference is that side support beam 51 comprises a cantilevered support member 51 similar to opposing cantilevered support member 50. In this embodiment, center support portion 54 comprises a center support beam 54 which is disposed at an angle of 90° to cantilevered support members 50 and 51, so that center support beam 54 does not come into contact with cantilevered support members 50 and 51, as shown in FIG. 9. More particularly, to avoid a short circuit between the two electrical contacts of lamp socket 10, shell 32 (negative contact) resting on cantilevered support members 50 and 51 and center contact 56 (positive contact) are separated so that contact between the two contacts is prevented. As previously disclosed hereinbefore, center contact 56 is isolated from shell 32 by receiving center contact 56 within center slot opening 42 of shell 32. A liquid, e.g., rain water, or gas flows through drainage passageways 300 to prevent accumulation or pooling of the liquid or gas within the interior of socket housing 12.

Thus, in accordance with the present invention, a lamp socket 10 is provided with a socket housing 12 which includes a plurality of drain passageways which permit rain water, gas, or any moisture to freely flow through socket housing 12 thereby preventing any liquid or gas from accumulating in socket housing 12. Consequently, by preventing the accumulation of a liquid or gas within socket housing 12, short circuiting between the electrical components of lamp socket 10 is eliminated by the present invention and lamp socket 10 is fully functional for use in the outdoors subject to a variety of meteorological conditions. Lamp socket 10 of the present invention is particularly suitable for use in electrical devices using A19 light bulbs or any other suitable light bulb and is preferably used as regular lamp sockets for Christmas decorative displays and decorative light sets.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A seasonal lamp socket comprising:

a socket body having a rear skirt portion and a conical receiver portion; said conical receiver portion having an internal surface and a cavity extending from an open first end to an open second end thereof, wherein a first annular wall extends between said first and second ends of said conical receiver portion, said rear skirt portion having a first end and a second end and a second annular wall extending between said first and second ends, wherein an inner surface is formed at said second end of said rear skirt, said second end of said rear skirt being coupled to second end of said conical receiver portion;

first and second support members formed in said inner surface of said rear skirt, wherein said first and second support members define at least one cavity formed in said inner surface of said rear skirt;

a socket shell having a first open end and a second partially open end, said socket shell having an internal surface with threads formed therein for coupling with a threaded base portion of a lamp; said socket shell disposed within said socket body by coupling said second partially open end of said socket shell to said first and second support members whereby said first and second support members support said socket shell;

a plurality of drainage passageways extending between said open first end of said conical receiver portion and first end of said rear skirt to permit fluid flow therebetween; wherein said second partially open end of said socket shell is in fluid communication with said at least one cavity of said rear skirt and said cavity is in fluid communication with said first ends of said conical receiver portion and said rear skirt; and a pair of contacts disposed within said socket body, wherein one contact comprises said socket shell and the other comprises a center metal contact plate disposed on said second support member, said first and second contacts for conductive contact with a respective lamp terminal at a bottom end of the base portion of the lamp.

2. The seasonal lamp socket of claim 1, wherein said rear skirt includes an outer surface at said first end, said outer surface having first and second spaced wireways for receiving electric wires, wherein said wireways extend inwardly from said second annular wall toward the center of said rear skirt.

3. The seasonal lamp socket of claim 2, wherein said spaced wireways have apertures therein, said apertures in fluid communication with said cavities of said inner surface of said rear skirt.

4. The seasonal lamp socket of claim 2, wherein said second partially open end of said socket shell includes a central slot opening for receiving said center metal contact plate and at least one aperture for mounting said socket shell to said first and second support members.

5. The seasonal lamp socket of claim 1, wherein said first and second support members each have an aperture extending therethrough for mounting said socket shell to said first and second support members.

6. The seasonal lamp socket of claim 2, wherein said first support member comprises a cantilevered support member having an aperture extending therethrough, wherein said cantilevered support member inwardly extends from said second annular of said rear skirt.

7. The seasonal lamp socket of claim 1, wherein said second support member comprises a side support beam extending inward from the said second annular wall of said rear skirt, wherein said side support beam includes a center portion disposed within the center of said rear skirt for supporting said center metal contact plate.

8. The seasonal lamp socket of claim 7, wherein said side support beam includes a side support aperture for mounting said socket shell to said rear skirt and a center aperture to permit an electrical connection between the wire in one of the spaced slots and the center metal contact plate.

9. The seasonal lamp socket of claim 8, wherein said side support aperture permits an electrical connection between the wire in the first spaced slot and the socket shell mounted to said side support beam.

10. The seasonal lamp socket of claim 6, wherein said outer surface further includes a recessed slot for receiving a mounting bracket.

11. The seasonal lamp socket of claim 10, wherein said aperture in said cantilevered support member is in fluid communication with said recessed slot.

12. The seasonal lamp socket of claim 1, wherein said inner surface further includes:

a center support beam extending between said second annular wall of said rear skirt, said center support beam supporting said center metal contact plate; and wherein said first and second support members comprise first and second cantilevered support members integrally connected to said second annular wall of said rear skirt, said first and second cantilevered support members each having an aperture extending therethrough, and wherein said first cantilevered support member, said second cantilevered support member, and said center support beam are not in contact with one another.

13. The seasonal lamp socket of claim 12, wherein said center support beam includes a center aperture extending therethrough for coupling said center metal contact plate and an electric wire terminal to said center support beam.

14. The seasonal lamp socket of claim 12, wherein said center support beam is disposed at an angle of 90° to said first and second cantilevered support members whereby said center support beam does not come into contact with said first and second cantilevered support members.

15. The seasonal lamp socket of claim 6, wherein at least one drainage passageway is formed around the outer periphery of said cantilevered support member.

* * * * *